US007050019B1

(12) United States Patent
Jacomb-Hood et al.

(10) Patent No.: US 7,050,019 B1
(45) Date of Patent: May 23, 2006

(54) CONCENTRIC PHASED ARRAYS SYMMETRICALLY ORIENTED ON THE SPACECRAFT BUS FOR YAW-INDEPENDENT NAVIGATION

(75) Inventors: Anthony W. Jacomb-Hood, Yardley, PA (US); Erik Lier, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 303 days.

(21) Appl. No.: 10/442,015

(22) Filed: May 19, 2003

Related U.S. Application Data

(60) Provisional application No. 60/409,602, filed on Sep. 11, 2002.

(51) Int. Cl.
*H01Q 21/00* (2006.01)

(52) U.S. Cl. ..... 343/893; 343/824; 343/853

(58) Field of Classification Search ..... 343/893, 343/853, 844, 770, 824, 725, DIG. 2; 342/376, 342/368; H01Q 21/00
See application file for complete search history.

(56) References Cited

U.S. PATENT DOCUMENTS

| | | | | |
|---|---|---|---|---|
| 2,786,133 | A | | 3/1957 | Dyke |
| 2,951,152 | A | | 8/1960 | Sichak et al. |
| 4,797,682 | A | * | 1/1989 | Klimczak ..... 343/844 |
| 4,885,589 | A | | 12/1989 | Edward et al. |
| 4,939,527 | A | | 7/1990 | Lamberty et al. |
| 5,017,927 | A | | 5/1991 | Agrawal et al. |
| 5,291,475 | A | | 3/1994 | Bruckert |
| 5,345,603 | A | | 9/1994 | Laffont |
| 5,394,561 | A | | 2/1995 | Freeburg |
| 5,459,474 | A | | 10/1995 | Mattioli et al. |
| 5,515,060 | A | * | 5/1996 | Hussain et al. ..... 342/376 |

(Continued)

FOREIGN PATENT DOCUMENTS

| | | |
|---|---|---|
| EP | 0276817 | 3/1988 |
| EP | 0798209 | 10/1997 |
| GB | 2251360 | 7/1992 |
| JP | 0248124 | 10/1990 |
| WO | WO 00/07307 | 2/2000 |

OTHER PUBLICATIONS

Kilgus, Dr. C.C., Spacecraft and Ground Station Applications of the Resonant Quadrifilar Helix, IEEE International Conference, 1974, pp. 75–77.

Kilgus, Dr. C.C., Resonant Quadrifilar Helix Design, The Microwave Journal, Dec. 1970, pp. 49–54.

Hall, P.S. et al., Review of Radio Frequency Beamforming Techniques for Scanned and Multiple Beam Antennas, IEEE Proceedings Parl H., Oct. 1, 1990, pp. 293–303, vol. 137, No. 5.

*Primary Examiner*—Hoanganh Le
(74) *Attorney, Agent, or Firm*—McDermott Will & Emery LLP

(57) ABSTRACT

A concentric arrangement of multiple spacecraft antennas mounted symmetrically about the yaw axis of rotation or center of gravity of the spacecraft that provides the capability for spacecraft with multiple antennas to maneuver without introducing errors into navigation signals and without adding complexity to the spacecraft and/or remote terminals. An arrangement of multiple spacecraft antennas comprising a first antenna array mounted on a spacecraft bus, the first antenna array having a center located on a yaw axis of the spacecraft and a second antenna array mounted on the spacecraft bus, the second antenna array having a coincident or overlapping frequency band as the first antenna array and mounted symmetrically about the yaw axis of the spacecraft in a central portion of the first antenna array so as to be concentric with the first antenna array.

64 Claims, 15 Drawing Sheets

U.S. PATENT DOCUMENTS 5,572,219 A 11/1996 Silverstein et al.
5,663,736 A 9/1997 Webb et al.
5,666,128 A 9/1997 Murray et al.
5,675,343 A 10/1997 Champeau
5,708,969 A 1/1998 Kotzin et al.
5,734,983 A 3/1998 Faruque
5,740,536 A 4/1998 Benveniste
5,768,266 A 6/1998 Thompson et al.
5,790,070 A 8/1998 Natarajan et al.
5,790,071 A 8/1998 Silverstein et al.
5,870,063 A 2/1999 Cherrette et al.
5,900,837 A * 5/1999 Petrosian ..... 342/368
5,927,654 A 7/1999 Foley et al.
6,002,360 A 12/1999 Wolcott et al.
6,043,776 A 3/2000 Chiba et al.
6,084,545 A 7/2000 Lier et al.
6,112,094 A 8/2000 Dent
6,157,621 A 12/2000 Brown et al.
6,163,296 A 12/2000 Lier et al.
6,172,655 B1 1/2001 Volman
6,232,920 B1 5/2001 Brookner et al.
6,239,762 B1 5/2001 Lier
6,246,364 B1 6/2001 Rao et al.
6,362,780 B1 3/2002 Butz et al.
6,366,238 B1 4/2002 DeMore et al.
6,377,561 B1 4/2002 Black et al.
6,404,404 B1 * 6/2002 Chen et al. ..... 343/844
6,407,722 B1 6/2002 Bogner et al.
6,411,256 B1 6/2002 Lier et al.
6,504,516 B1 * 1/2003 Davis ..... 343/853
6,507,315 B1 1/2003 Purdy et al.
6,522,643 B1 2/2003 Jacomb-Hood et al.
2001/0034206 A1 10/2001 Thompson et al.
2002/0171583 A1 11/2002 Purdy et al.
2002/0171585 A1 11/2002 Eiges

* cited by examiner

1300

CONCENTRIC PHASED ARRAYS SYMMETRICALLY ORIENTED ON THE SPACECRAFT BUS FOR YAW-INDEPENDENT NAVIGATION

CROSS-REFERENCES TO RELATED APPLICATIONS

This patent application claims the benefit of U.S. Provisional Patent Application Ser. No. 60/409,602 filed on Sep. 11, 2002 and entitled "Phased Array Symmetrically Oriented on the Spacecraft Bus for Yaw-Independent Navigation (GPS-3)," the entirety of which is incorporated by reference herein for all purposes.

BACKGROUND OF THE INVENTION

The present invention relates generally to spacecraft antenna arrangements, and more particularly to a concentric arrangement of multiple spacecraft antennas mounted symmetrically about the yaw axis of rotation of the spacecraft.

A wide variety of spacecraft, such as global positioning system satellites, weather satellites, etc., are in orbit around the Earth. In order to maintain proper orbit and proper communications, many such spacecraft must maneuver while in orbit. However, problems may arise during such maneuvers. Such spacecraft typically have multiple antennas. Those antennas that are not aligned with the yaw axis of rotation or center of gravity of the spacecraft may experience problems.

For example, global positioning system (GPS) satellites are placed in a medium earth orbit (MEO) at an altitude of approximately 20190 kilometers. This provides an orbital period of approximately 12 hours. Some satellite manufacturers require that their GPS satellites perform a yaw maneuver of 180 degrees twice per orbit, or four times per day, in order to keep one side of the spacecraft pointing away from the sun at all times to keep the spacecraft thermally stable. Since the location of the spacecraft antenna is used to compute the coordinates of the receiver, information about the movement of non yaw symmetric antennas must be transmitted to the receiver in order to properly compute the receiver location. This adds significant complexity to the system, both in the spacecraft and in ground terminals.

A need arises for a technique by which spacecraft with multiple antennas can maneuver without disrupting communications or signals and without adding complexity to the spacecraft and/or ground terminals. In particular, a need arises for such a technique for spacecraft having coincident or overlapping frequency band antennas.

BRIEF SUMMARY OF THE INVENTION

The present invention relates to a concentric arrangement of multiple spacecraft antennas, having coincident or overlapping frequency bands, mounted symmetrically about the yaw axis of rotation or center of gravity of the spacecraft that provides the capability for spacecraft with multiple antennas to maneuver without introducing errors into navigation signals and without adding complexity to the spacecraft and/or receivers.

In one embodiment of the present invention, an arrangement of multiple spacecraft antennas comprises a first antenna array mounted on a spacecraft bus, the first antenna array mounted symmetrically about a yaw axis of the spacecraft, and a second antenna array mounted on the spacecraft bus, the second antenna array having a coincident or overlapping frequency band as the first antenna array and mounted symmetrically about the yaw axis of the spacecraft in a central portion of the first antenna array so as to be concentric with the first antenna array.

In accordance with this embodiment of the present invention, the first antenna array and/or the second antenna array may comprise a plurality of antenna elements. In some embodiments, the antenna elements of the first antenna array and/or the antenna elements of the second antenna array may comprise planar antenna elements, helical antenna elements, or any other suitable antenna element configuration.

In one embodiment of the present invention, the elements of the second antenna array are interleaved with at least a portion of the elements of the first antenna array. In an alternative embodiment, the elements of the second antenna array are mounted in an area that includes no elements of the first antenna array. In accordance with these particular embodiments, the antenna elements of the first antenna array and/or the antenna elements of the second antenna array may comprise planar antenna elements, helical antenna elements, or any other suitable antenna element configuration.

In some embodiments of the present invention, the plurality of antenna elements of the second antenna array may have an even spacing, and the plurality of antenna elements of the first antenna array may have an uneven spacing. In other embodiments, the plurality of antenna elements of the second antenna array may have an uneven spacing, and the plurality of antenna elements of the first antenna array may have an even spacing. In yet other embodiments, the antenna elements of the first antenna array and the antenna elements of the second antenna array both may have either an even spacing or an uneven spacing.

In some embodiments of the present invention, the first antenna array is a Navigation Warfare Global Positioning System antenna, and the second antenna array is an Earth Coverage Global Positioning System antenna.

In yet other embodiments of the present invention, the first antenna array may further comprise a plurality of additional antenna elements mounted on a plurality of deployed panels. The antenna elements of the first antenna array mounted on the spacecraft bus, and the antenna elements of the first antenna array mounted on the deployed panels may comprise a similar type of antenna element, or they may comprise different types of antenna elements.

In yet other embodiments of the present invention, the arrangement may further comprise at least one additional antenna array mounted symmetrically about the yaw axis of the spacecraft so as to be concentric with the first antenna array. The at least one additional antenna array may have a coincident or overlapping frequency band as the first antenna array.

A more complete understanding of the present invention may be derived by referring to the detailed description of preferred embodiments and claims when considered in connection with the figures.

BRIEF DESCRIPTION OF THE DRAWINGS

In the Figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION OF THE INVENTION

The present invention relates generally to spacecraft antenna arrangements, and more specifically to a concentric arrangement of multiple spacecraft antennas mounted symmetrically about the yaw axis of rotation or center of gravity of the spacecraft. The antennas and antenna arrangement provides the capability for spacecraft with multiple antennas to perform yaw maneuvers without introducing errors into navigation signals, which would require added complexity to the spacecraft and/or remote receivers to correct.

Figure 1:
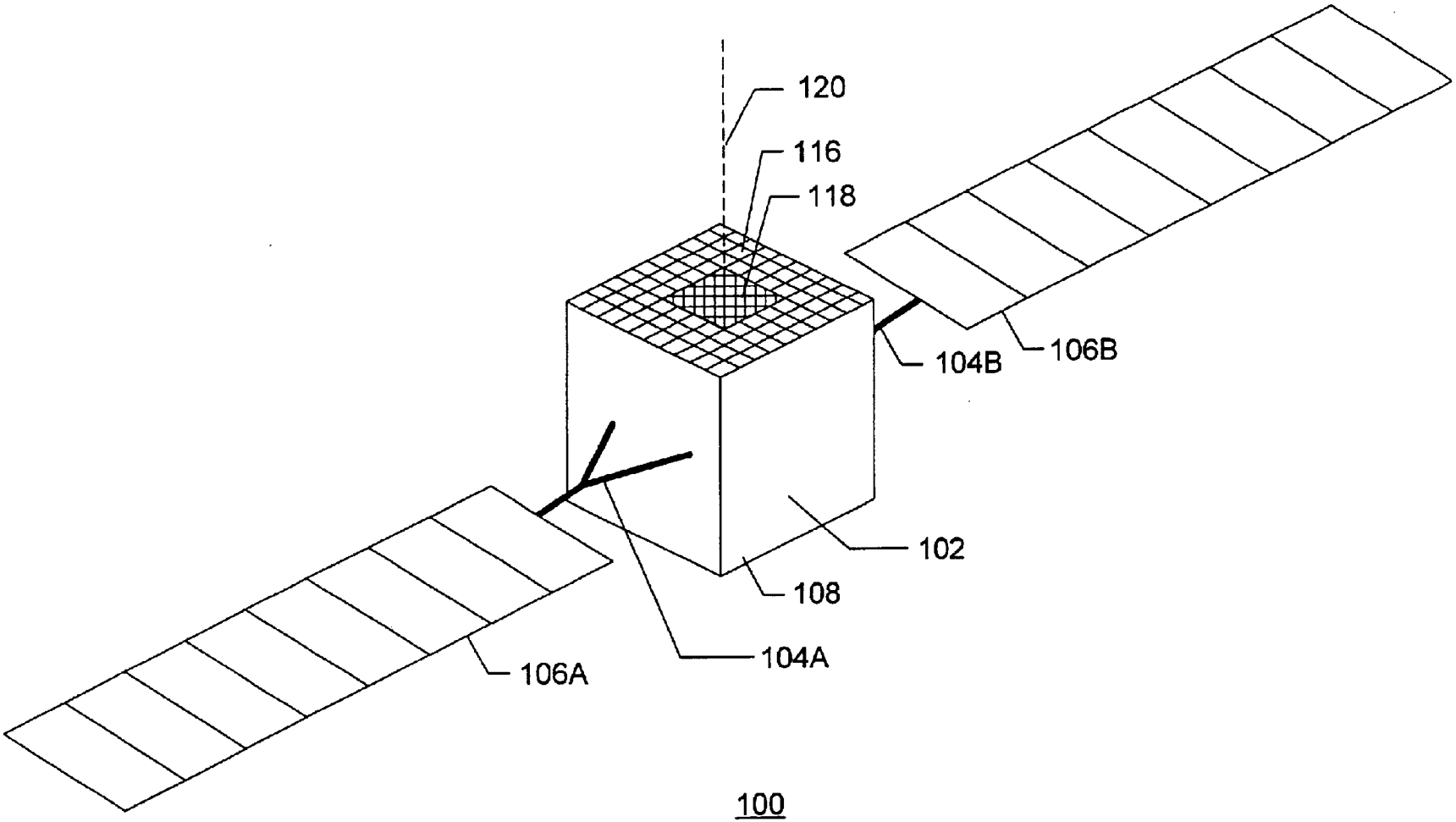
FIG. 1 is an illustration of an exemplary spacecraft including one embodiment of a concentric arrangement of multiple spacecraft antennas in accordance with the present invention.

Referring now to FIG. 1, one embodiment of an exemplary spacecraft 100 including a concentric arrangement of multiple spacecraft antennas of the present invention is shown. Spacecraft 100 includes a spacecraft body or bus 102. Attached to spacecraft bus 102 by support members 104A and 104B are deployed solar panels 106A and 106B, which produce electrical energy in known fashion. The produced electrical energy is stored in an electrical battery or other power supply or electrical storage for satisfying peak loads and for those intervals in which the solar panels may be in shadow. Mounted on spacecraft bus 102 are antennas 116 and 118, which are concentric with each other and centered symmetrically about a yaw axis of rotation 120 of spacecraft 100. Spacecraft 100 also may include other antennas, such as deployed antennas, which are not shown in FIG. 1.

Figure 2:
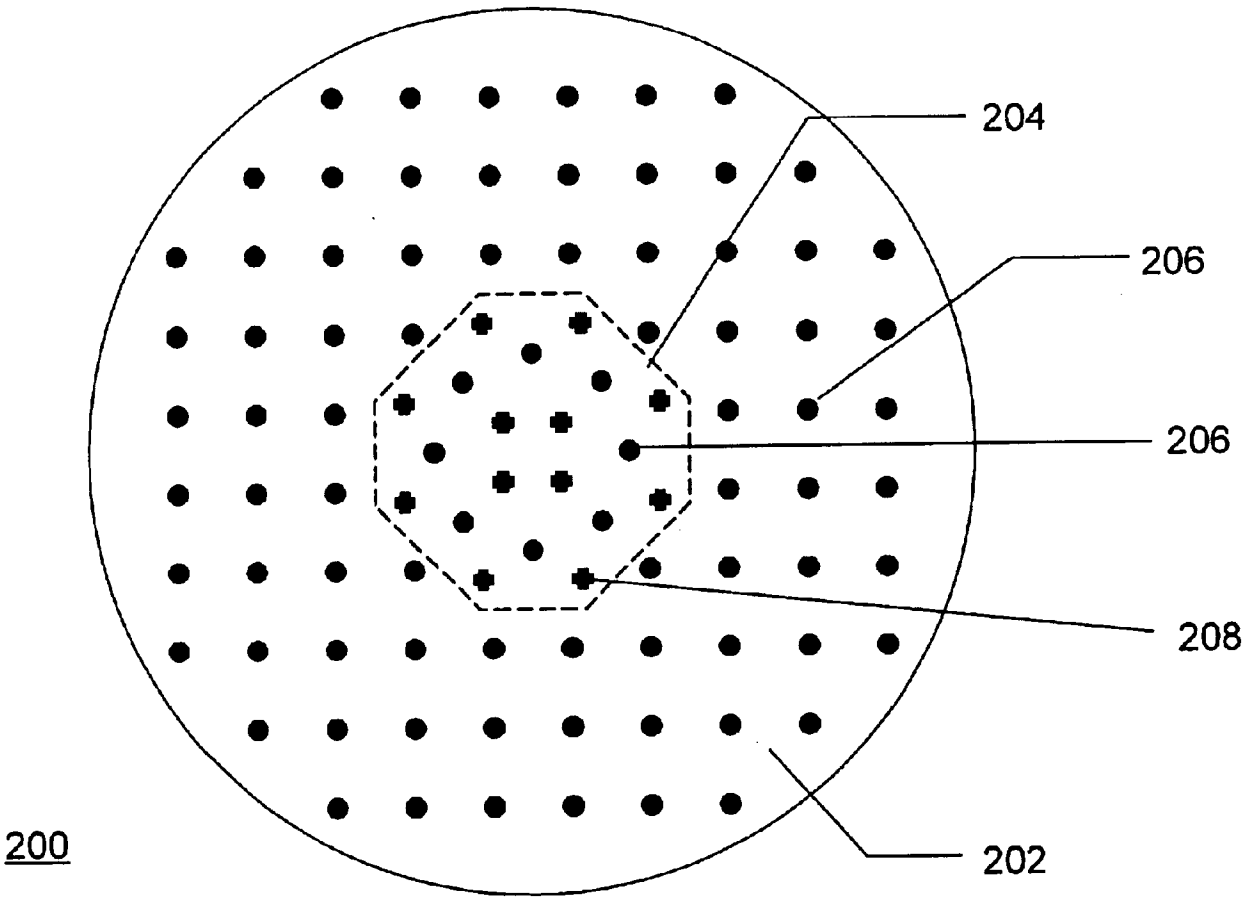
FIG. 2 is an illustration of one embodiment of an exemplary concentric arrangement of multiple spacecraft antennas in accordance with the present invention.

Referring now to FIG. 2, one embodiment of an exemplary concentric arrangement of multiple spacecraft antennas 200 is shown. Antenna arrangement 200 includes a first concentric antenna array 202 and a second concentric antenna array 204. Antenna array 202 and antenna array 204 are mounted on a spacecraft bus, for example, bus 102 shown in FIG. 1, symmetrically about the yaw axis of rotation. In this embodiment, antenna array 202 comprises an array having 84 antenna elements 206, while antenna array 204 comprises a concentric array having 12 interleaved antenna elements 208 located in the central portion of antenna array 202. In this example, the 76 outer elements 206 of antenna array 202 have a square grid spacing, while the eight central elements 206 of antenna array 202 have been re-spaced to interleave with the 12 elements 208 of antenna array 204. Antenna array 202 may extend beyond the edge of the spacecraft bus 102.

In one embodiment of the present invention, antenna array 202 is a Navigation Warfare Global Positioning System (Nav-War) array, while antenna array 204 is an Earth Coverage Global Positioning System (EC) array. EC antenna array 204 provides a signal type and signal coverage similar to that provided by current GPS spacecraft. Specifically, EC antenna array 204 covers the earth, which is approximately +/−14 degrees viewed from the spacecraft. For the next generation GPS there is a need also for a Nav-War antenna, such as Nav-War antenna array 202, which has a much narrower beam and more power in order to give sufficient signal-to-noise ratio during jamming. A narrower beam requires a larger antenna aperture compared to the EC antenna.

A GPS receiver on the ground, on the water, or in flight typically receives signals from at least 4 spacecraft at any given time, from which the GPS receiver can determine its location. Important information for the GPS receiver includes the electrical distance to the center of gravity of the spacecraft, which is shown in FIG. 1. Since GPS spacecraft typically perform a continuous yaw maneuver, the distance correction required to correct for the difference between the distance from the GPS receiver to the center of the Nav-War antenna, and the distance from the GPS receiver to the satellite center of gravity will need to be continuously updated, unless the Nav-War antenna is concentric with the spacecraft axis of rotation. The exact timing of yaw maneuvers is not known sufficiently accurately by the GPS receiver to permit an open loop correction scheme. Thus, the spacecraft would need to continually transmit the correction factor. The use of a concentric antenna array configuration eliminates the need for the GPS receiver to be given dynamic update information for the spacecraft orientation.

One skilled in the art will appreciate that a GPS spacecraft with Nav-War and EC antenna arrays is only one example of an implementation of the present invention. The present invention is equally applicable to other systems and that the present invention contemplates application to other such systems.

In addition, a spacecraft may include additional antennas, which are not concentric with the spacecraft center of gravity. These antennas may be used for functions that are not sensitive to spacecraft yaw. Nothing related to the present invention precludes the use of such antennas, in addition to the use of the concentric antennas of the present invention.

Figure 3:
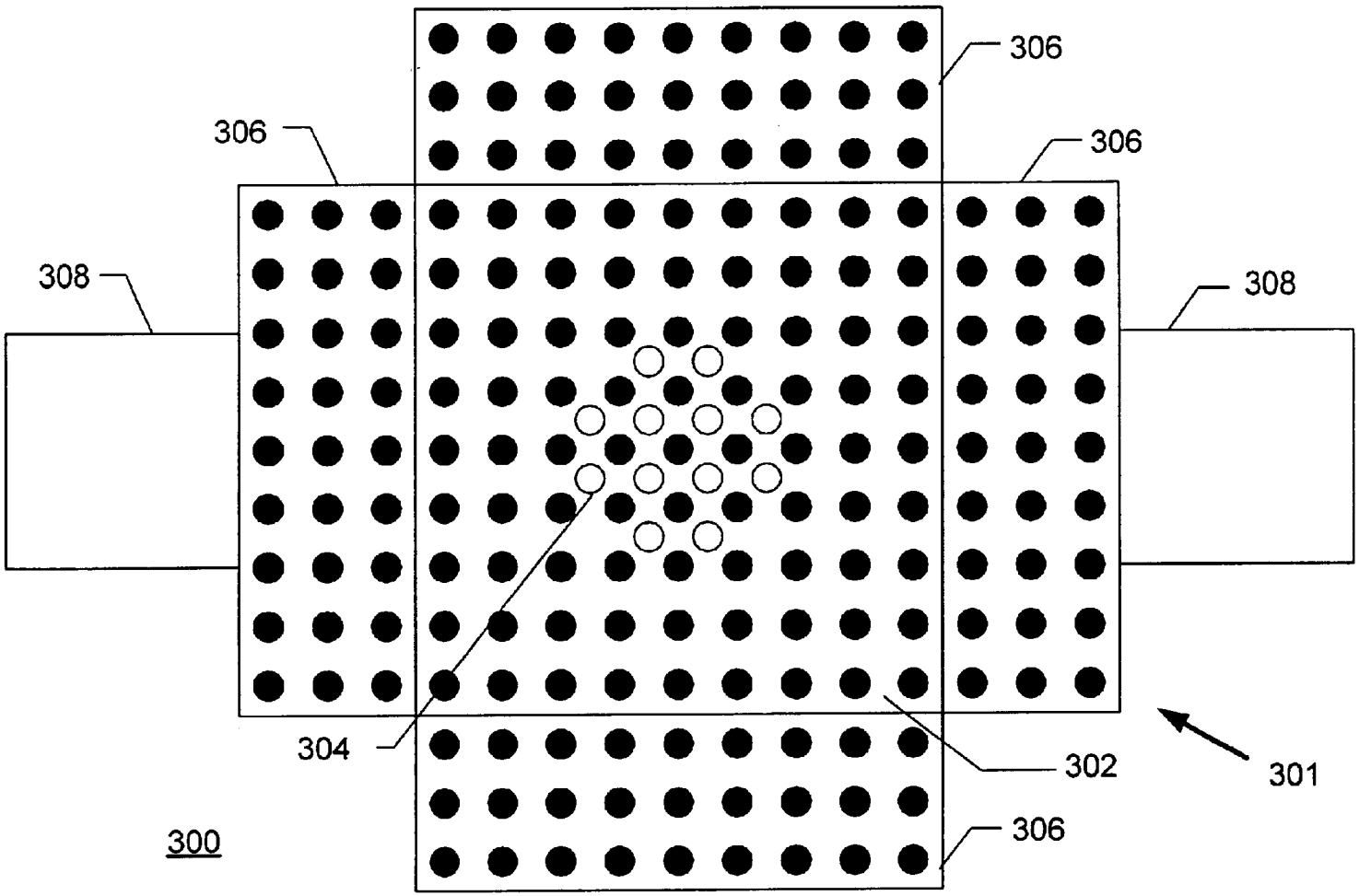
FIG. 3 is an illustration of another embodiment of an exemplary concentric arrangement of multiple spacecraft antennas in accordance with the present invention.

Referring now to FIG. 3, one embodiment of an exemplary concentric arrangement of multiple spacecraft antennas 300 is shown. Antenna arrangement 300 includes a first concentric antenna array 301, including antenna sub-array 302 and antenna sub-array panels 306, and a second concentric antenna array 304. Antenna sub-array 302 and antenna array 304 are mounted, for example, on a spacecraft bus 102, shown in FIG. 1, symmetrically about the yaw axis of rotation.

Antenna sub-array panels 306 are deployed panels, which may be connected to the spacecraft bus. Antenna sub-array panels 306 form additional portions or extensions to antenna sub-array 302 and, with antenna sub-array 302, form antenna array 301. Antenna sub-array panels 306 are deployed symmetrically about the yaw axis of rotation of the spacecraft. The use of deployed panels, such as antenna sub-array panels 306 is not mandatory in implementing the present invention. Antenna sub-array panels 306 may be used when the necessary antenna elements that make-up antenna array 301 do not all fit on the spacecraft bus. In this case, deployed antenna sub-array panels 306 may be used to provide additional antenna elements for antenna array 301. The present invention, however, contemplates any arrangement, whether or not deployed panels are used.

In the embodiment illustrated in FIG. 3, antenna sub-array 302 includes a 9×9 element array, each antenna sub-array panel 306 includes a 9×3 element array, and antenna array 304 includes a concentric array of twelve interleaved elements located in the central portion of antenna sub-array 302. In this embodiment, no elements of antenna sub-array 302 have been removed or re-spaced, thus all elements of antenna sub-array 302 are evenly spaced. The elements of antenna array 304 are arranged on a square grid and are evenly spaced.

In one embodiment of the present invention, antenna array 301, which includes antenna sub-array 302 and antenna sub-array panels 306, is a Navigation Warfare Global Positioning System (Nav-War) array, while antenna array 304 is an Earth Coverage Global Positioning System (EC) array. It is to be noted that a GPS spacecraft with Nav-War and EC antenna arrays is only one example of an implementation of the present invention. One skilled in the art would recognize that the present invention is equally applicable to other systems and that the present invention contemplates application to other such systems.

In addition, a spacecraft may include additional antennas, which are not concentric with the spacecraft center of gravity. Such a non-concentric antenna may be deployed, such as antenna 308 or it may be mounted on the spacecraft bus. If mounted on the spacecraft bus, the non-concentric antenna may be mounted separately, or it may be interleaved with the elements of an existing antenna mounted on the spacecraft bus, such as antenna array 304. Such antennas may be used for functions that are not sensitive to spacecraft yaw. Nothing related to the present invention precludes the use of such antennas in addition to the use of the concentric antennas of the present invention.

Figure 4:
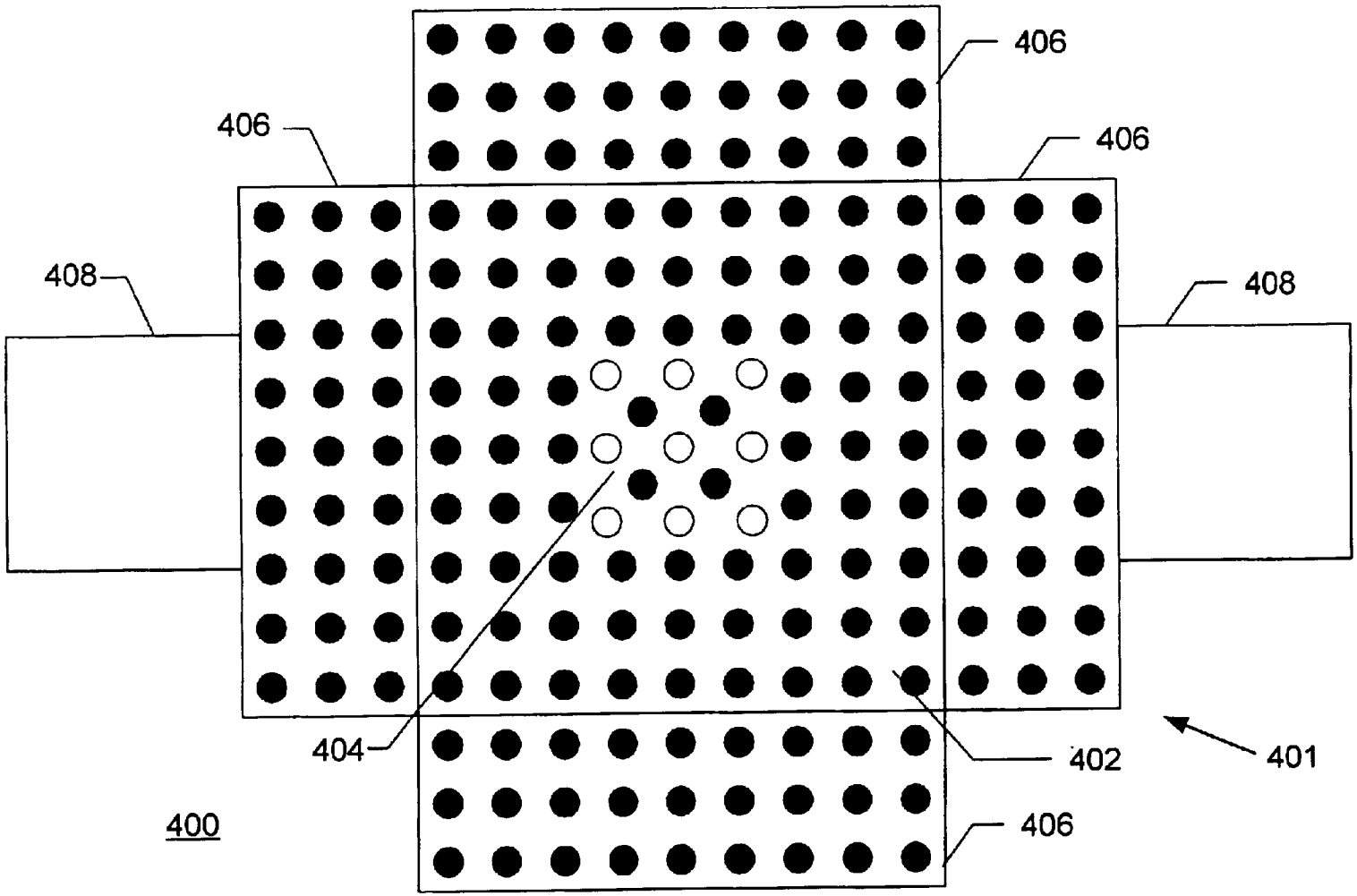
FIG. 4 is an illustration of yet another embodiment of an exemplary concentric arrangement of multiple spacecraft antennas in accordance with the present invention.

Referring now to FIG. 4, another embodiment of an exemplary concentric arrangement of multiple spacecraft antennas 400 is shown in FIG. 4. Antenna arrangement 400 includes a first concentric antenna array 401, including antenna sub-array 402 and antenna sub-array panels 406, and a second concentric antenna array 404. Antenna sub-array 402 and antenna array 404 are mounted, for example, on a spacecraft bus 102, shown in FIG. 1, symmetrically about the yaw axis of rotation.

Antenna sub-array panels 406 are deployed panels, which may be connected to the spacecraft bus. Antenna sub-array panels 406 form additional portions or extensions to antenna sub-array 402 and, with antenna sub-array 402, form antenna array 401. Antenna sub-array panels are deployed symmetrically about the yaw axis of rotation of the spacecraft. The use of deployed panels, such as antenna sub-array panels 406 is not mandatory in implementing the present invention. Antenna sub-array panels 406 may be used when the necessary antenna elements that make-up antenna array 401 do not all fit on the spacecraft bus. In this case, deployed antenna sub-array panels 406 may be used to provide additional antenna elements for antenna array 401. The present invention, however, contemplates any arrangement, whether or not deployed panels are used.

In the embodiment illustrated in FIG. 4, antenna sub-array 402 includes a 9×9 element array, each antenna sub-array panel 406 includes a 9×3 element array, and antenna array 404 includes a concentric array of nine interleaved elements located in the central portion of antenna sub-array 402. In this embodiment, five of the nine central elements of antenna sub-array 402 have been removed, and the remaining four have been re-spaced and thus are unevenly spaced with the remaining elements of antenna sub-array 402. The elements of antenna array 404 are arranged on a square grid and are evenly spaced.

In one embodiment of the present invention, antenna array 401, which includes antenna sub-array 402 and antenna sub-array panels 406, is a Navigation Warfare Global Positioning System (Nav-War) array, while antenna array 404 is an Earth Coverage Global Positioning System (EC) array. It is to be noted that a GPS spacecraft with Nav-War and EC antenna arrays is only one example of an implementation of the present invention. One skilled in the art would recognize that the present invention is equally applicable to other systems and that the present invention contemplates application to other such systems.

In addition, a spacecraft may include additional antennas, which are not concentric with the spacecraft center of gravity. An example of such an antenna is shown as antenna 408 in FIG. 4. Such antennas may be used for functions that are not sensitive to spacecraft yaw. Nothing related to the present invention precludes the use of such antennas, in addition to the use of the concentric antennas of the present invention.

Figure 5:
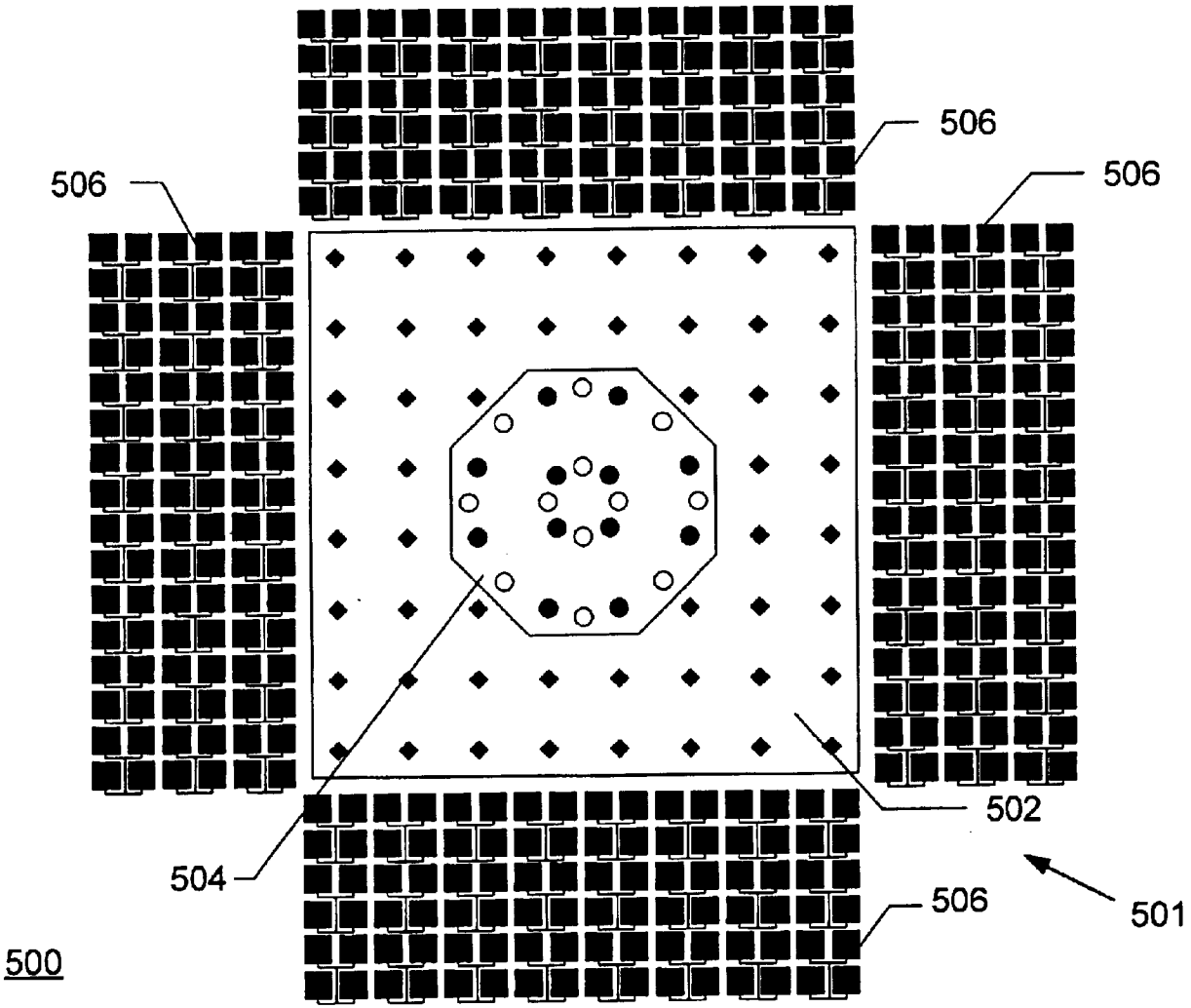
FIG. 5 is an illustration of still another embodiment of an exemplary concentric arrangement of multiple spacecraft antennas in accordance with the present invention.

Referring now to FIG. 5, another embodiment of an exemplary concentric arrangement of multiple spacecraft antennas 500 is shown. Antenna arrangement 500 includes a first concentric antenna array 501, including antenna sub-array 502 and antenna sub-array panels 506, and a second concentric antenna array 504. Antenna sub-array 502 and antenna array 504 are mounted, for example, on a spacecraft bus 102, shown in FIG. 1, symmetrically about the yaw axis of rotation.

Antenna sub-array panels 506 are deployed panels, which may be connected to the spacecraft bus. Antenna sub-array panels 506 form additional portions or extensions to antenna sub-array 502 and, with antenna sub-array 502, form antenna array 501. Antenna sub-array panels are deployed symmetrically about the yaw axis of rotation of the spacecraft. The use of deployed panels, such as antenna sub-array panels 506 is not mandatory in implementing the present invention. Antenna sub-array panels 506 may be used when the necessary antenna elements that make up antenna array 501 do not all fit on the spacecraft bus. In this case, deployed antenna sub-array panels 506 may be used to provide additional antenna elements for antenna array 501. The present invention, however, contemplates any arrangement, whether or not deployed panels are used.

One skilled in the art will appreciate that the elements of the various antenna arrays may be similar types of elements, or they may be different types of elements. In the embodiment illustrated in FIG. 5, the elements of antenna sub-array 502, which are mounted on the spacecraft bus, are helical antenna elements, while the elements of antenna sub-array panels 506, which are deployed panels, are planar or patch antenna elements. The present invention, however, contemplates any arrangement of types of antenna elements.

In the embodiment illustrated in FIG. 5, antenna sub-array 502 includes a 64 element array, each antenna sub-array panel 506 includes an 8×3 element array, and antenna array 504 includes a concentric array of twelve elements interleaved with the twelve antenna elements located in the central portion of antenna sub-array 502. The elements of antenna sub-array 502 are arranged on a square grid and are evenly spaced except for the twelve central antenna elements. The elements of antenna array 504 are unevenly spaced and are at a different spacing as are the elements of antenna sub-array 502. In one embodiment, the elements of antenna sub-array 502 may be either planar antenna elements or helical antenna elements, but the twelve central antenna elements typically are helical antenna elements, but also may be planar antenna elements. Similarly, the elements of antenna array 504 may be helical antenna elements, such as heritage or legacy helical antenna elements. Finally, in one embodiment, the elements of antenna panels 506 are planar antenna elements. The present invention, however, contemplates concentric arrangement of any type of antenna element.

In one embodiment of the present invention, antenna array 501 is a Navigation Warfare Global Positioning System (Nav-War) array, while antenna array 504 is an Earth Coverage Global Positioning System (EC) array. It is to be noted that a GPS spacecraft with Nav-War and EC antenna arrays is only one example of an implementation of the present invention. One skilled in the art would recognize that the present invention is equally applicable to other systems and that the present invention contemplates application to other such systems.

In addition, a spacecraft may include additional antennas, which are not concentric with the spacecraft center of gravity. These antennas may be used for functions that are not sensitive to spacecraft yaw. Nothing related to the present invention precludes the use of such antennas, in addition to the use of the concentric antennas of the present invention.

Figure 6:
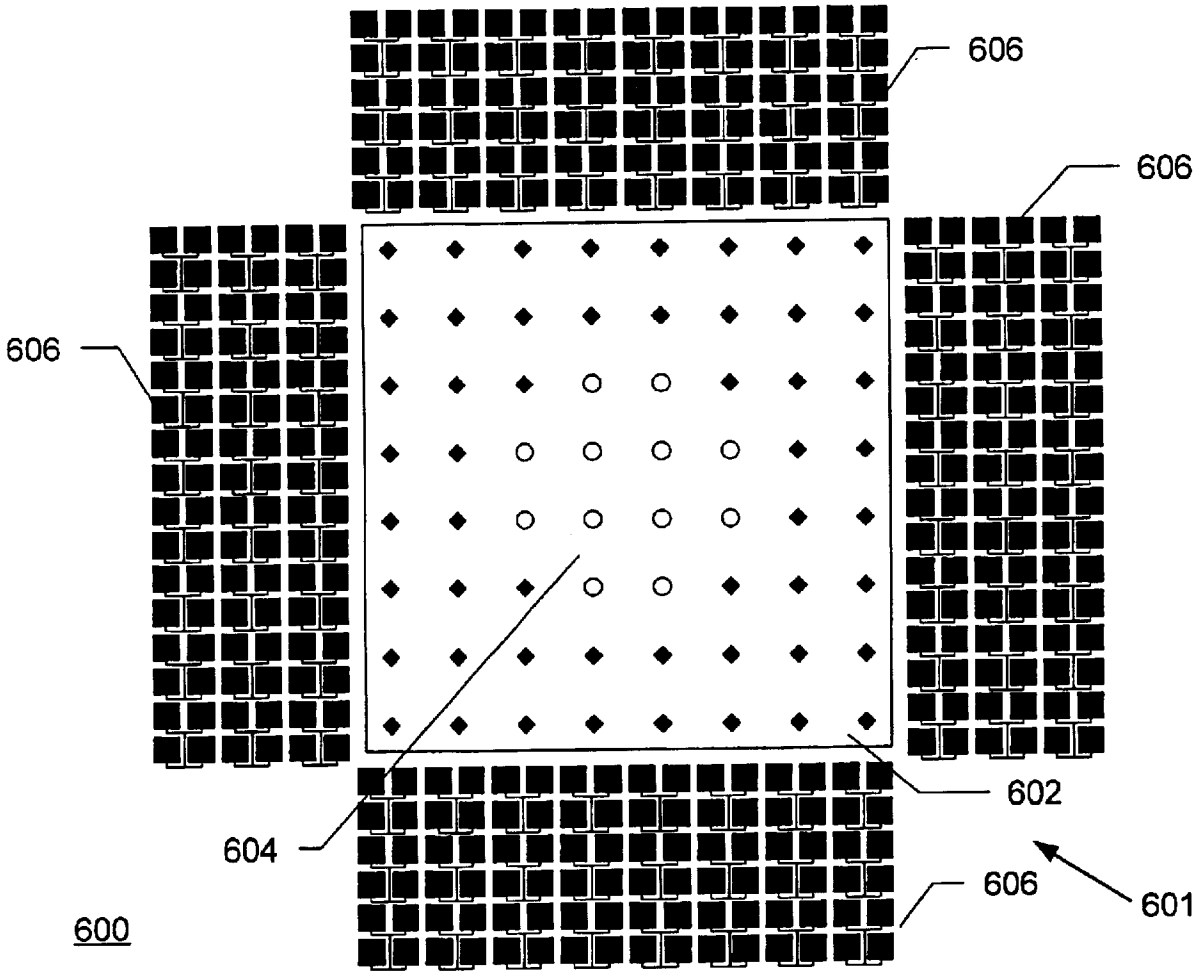
FIG. 6 is an illustration of another embodiment of an exemplary concentric arrangement of multiple spacecraft antennas in accordance with the present invention.

Referring now to FIG. 6, yet another embodiment of an exemplary concentric arrangement of multiple spacecraft antennas 600 is shown. Antenna arrangement 600 includes a first concentric antenna array 601, which includes antenna sub-array 602 and antenna sub-array panels 606, and a second concentric antenna array 604. Antenna sub-array 602 and antenna array 604 are mounted, for example, on a spacecraft bus 102, shown in FIG. 1, symmetrically about the yaw axis of rotation.

Antenna sub-array panels 606 are deployed panels, which may be connected to the spacecraft bus. Antenna sub-array panels 606 form additional portions or extensions to antenna sub-array 602 and, with antenna sub-array 602, form antenna array 601. Antenna sub-array panels are deployed symmetrically about the yaw axis of rotation of the spacecraft. The use of deployed panels, such as antenna sub-array panels 606 is not mandatory in implementing the present invention. Antenna sub-array panels 606 may be used when the necessary antenna elements that make up antenna array 601 do not all fit on the spacecraft bus. In this case, deployed antenna sub-array panels 606 may be used to provide additional antenna elements for antenna array 601. The present invention, however, contemplates any arrangement, whether or not deployed panels are used.

One skilled in the are will appreciate that the elements of the various antenna arrays may be similar types of elements, or they may be different types of elements. In this embodiment, the elements of antenna sub-array 602, which are mounted on the spacecraft bus, may be helical antenna elements, while the elements of antenna sub-array panels 606, which are deployed panels, may be planar or patch antenna elements. The present invention, however, contemplates any arrangement of types of antenna elements.

In the embodiment illustrated in FIG. 6, antenna sub-array 602 includes a 52 element array, configured as an 8×8 element array with the twelve central antenna elements removed, each antenna sub-array panel 606 includes an 8×3 element array, and antenna array 604 includes a concentric array of twelve elements located in the central portion of antenna sub-array 602. The elements of antenna sub-array 602 are arranged on a square grid and are evenly spaced. The elements of antenna array 604 are also arranged on a square grid and are evenly spaced at the same spacing as the elements of antenna sub-array 602. The elements of antenna sub-array 602 may be either planar antenna elements or helical antenna elements, while the elements of antenna panels 606 are planar antenna elements. The elements of antenna array 604 are helical antenna elements, but may be planar antenna elements. The present invention, however, contemplates concentric arrangement of any types of antenna element.

In one embodiment of the present invention, antenna array 601 is a Navigation Warfare Global Positioning System (Nav-War) array, while antenna array 604 is an Earth Coverage Global Positioning System (EC) array. It is to be noted that a GPS spacecraft with Nav-War and EC antenna arrays is only one example of an implementation of the present invention. One skilled in the art would recognize that the present invention is equally applicable to other systems and that the present invention contemplates application to other such systems.

In addition, a spacecraft may include additional antennas, which are not concentric with the spacecraft center of gravity. These antennas may be used for functions that are not sensitive to spacecraft yaw. Nothing related to the present invention precludes the use of such antennas, in addition to the use of the concentric antennas of the present invention.

Figure 7:
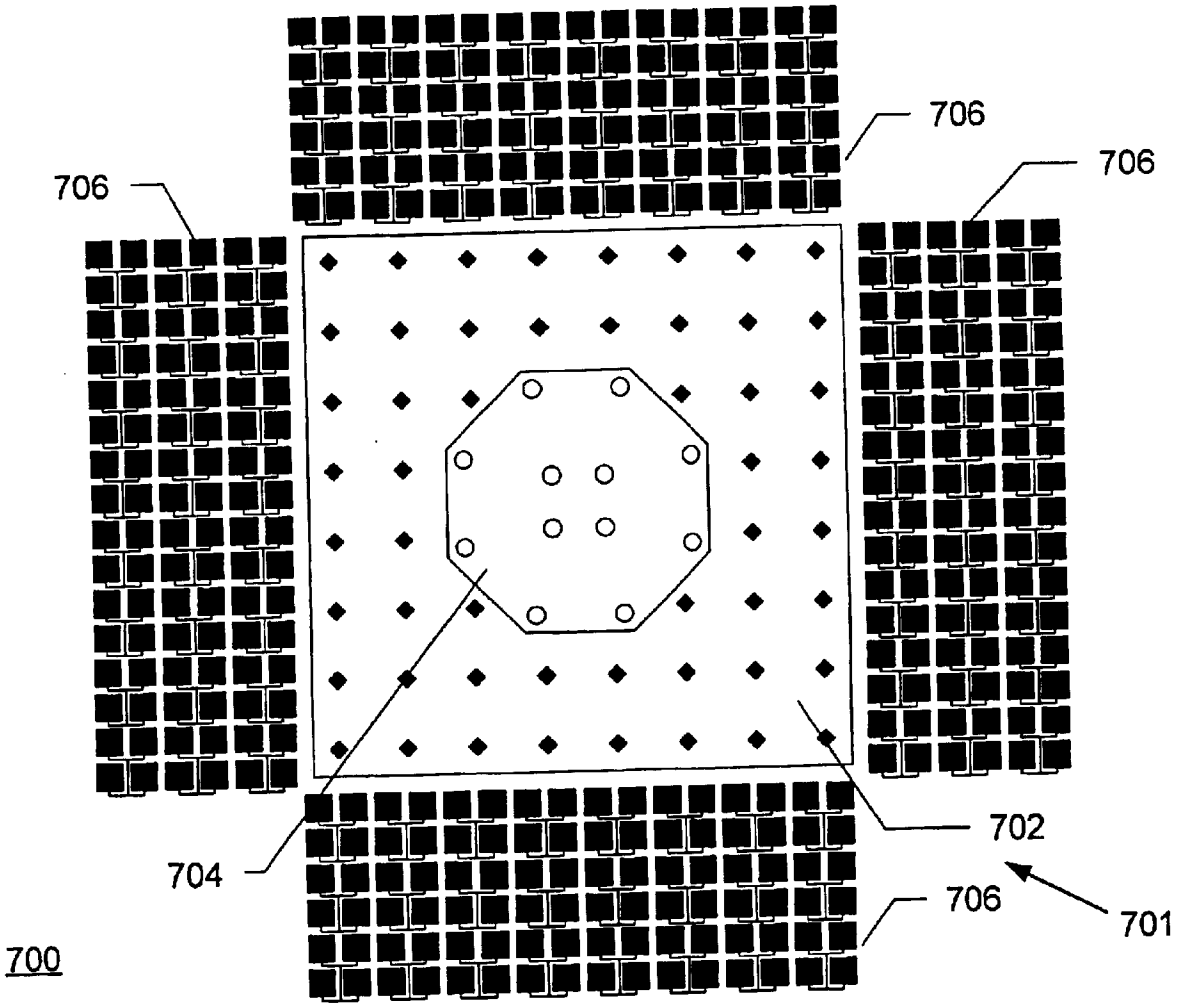
FIG. 7 is an illustration of another embodiment of an exemplary concentric arrangement of multiple spacecraft antennas in accordance with the present invention.

Referring now to FIG. 7, another embodiment of an exemplary concentric arrangement of multiple spacecraft antennas 700 is shown. Antenna arrangement 700 includes a first concentric antenna array 701, including antenna sub-array 702 and antenna sub-array panels 706, and a second concentric antenna array 704. Antenna sub-array 702 and antenna array 704 are mounted, for example, on a spacecraft bus 102, shown in FIG. 1, symmetrically about the yaw axis of rotation.

Antenna sub-array panels 706 are deployed panels, which may be connected to the spacecraft bus. Antenna sub-array panels 706 form additional portions or extensions to antenna sub-array 702 and, with antenna sub-array 702, form antenna array 701. Antenna sub-array panels are deployed symmetrically about the yaw axis of rotation of the spacecraft. The use of deployed panels, such as antenna sub-array panels 706 is not mandatory in implementing the present invention. Antenna sub-array panels 706 may be used when the necessary antenna elements that make up antenna array 701 do not all fit on the spacecraft bus. In this case, deployed antenna sub-array panels 706 may be used to provide additional antenna elements for antenna array 701. The present invention, however, contemplates any arrangement, whether or not deployed panels are used.

One skilled in the art will appreciate that the elements of the various antenna arrays may be similar types of elements, or they may be different types of elements. In this embodiment, the elements of antenna sub-array 702, which are mounted on the spacecraft bus, are helical antenna elements, while the elements of antenna sub-array panels 706, which are deployed panels, are planar or patch antenna elements. The present invention, however, contemplates any arrangement of types of antenna elements.

In this embodiment, antenna sub-array 702 includes a 52 element array configured as an 8×8 element array configuration with the twelve central antenna elements removed, each antenna sub-array panel 706 includes an 8×3 element array, and antenna array 704 includes a concentric array of twelve elements located in the central portion of antenna sub-array 702. The elements of antenna sub-array 702 are arranged on a square grid and are evenly spaced. The elements of antenna array 704 are unevenly spaced and are at a different spacing to the elements of antenna sub-array 702. The elements of antenna sub-array 702 may be either planar antenna elements or helical antenna elements, while the elements of antenna panels 706 are planar antenna elements. The elements of antenna array 704 may be helical antenna elements, such as heritage or legacy helical antenna elements. The present invention, however, contemplates concentric arrangement of any types of antenna element.

In one embodiment of the present invention, antenna array 701 is a Navigation Warfare Global Positioning System (Nav-War) array, while antenna array 704 is an Earth Coverage Global Positioning System (EC) array. It is to be noted that a GPS spacecraft with Nav-War and EC antenna arrays is only one example of an implementation of the present invention. One skilled in the art would recognize that the present invention is equally applicable to other systems and that the present invention contemplates application to other such systems.

In addition, a spacecraft may include additional antennas, which are not concentric with the spacecraft center of gravity. These antennas may be used for functions that are not sensitive to spacecraft yaw. Nothing related to the present invention precludes the use of such antennas, in addition to the use of the concentric antennas of the present invention.

Figure 8:
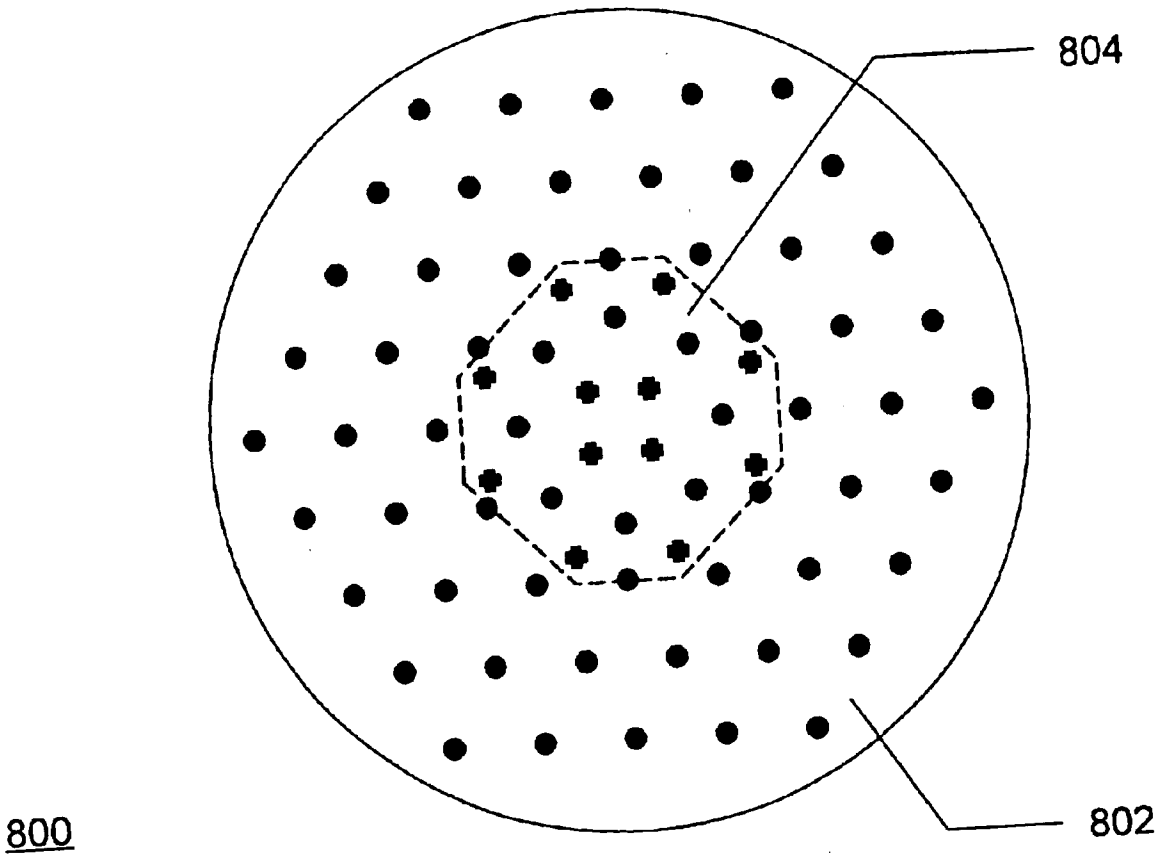
FIG. 8 is an illustration of still another embodiment of an exemplary concentric arrangement of multiple spacecraft antennas in accordance with the present invention.

Referring now to FIG. 8, yet another embodiment of an exemplary concentric arrangement of multiple spacecraft antennas 800 is shown. Antenna arrangement 800 includes a first concentric antenna array 802 and a second concentric antenna array 804. Antenna array 802 and antenna array 804 are mounted, for example, on a spacecraft bus 102, shown in FIG. 1. In this example, antenna array 802 includes a 62 element array, while antenna array 804 includes a concentric array of twelve interleaved elements located in the central portion of antenna array 802. In this example, the 54 outer elements of antenna array 802 have a triangular grid spacing, while the eight central elements of antenna array 802 have been re-spaced to interleave with the 12 elements of antenna array 804. In the illustrated embodiment, the elements of antenna array 802 may be either planar antenna elements or helical antenna elements. The present invention, however, contemplates concentric arrangement of any type of antenna element.

In one embodiment of the present invention, antenna array 802 is a Navigation Warfare Global Positioning System (Nav-War) array, while antenna array 804 is an Earth Coverage Global Positioning System (EC) array. It is to be noted that a GPS spacecraft with Nav-War and EC antenna arrays is only one example of an implementation of the present invention. One skilled in the art would recognize that the present invention is equally applicable to other systems and that the present invention contemplates application to other such systems.

Figure 9:
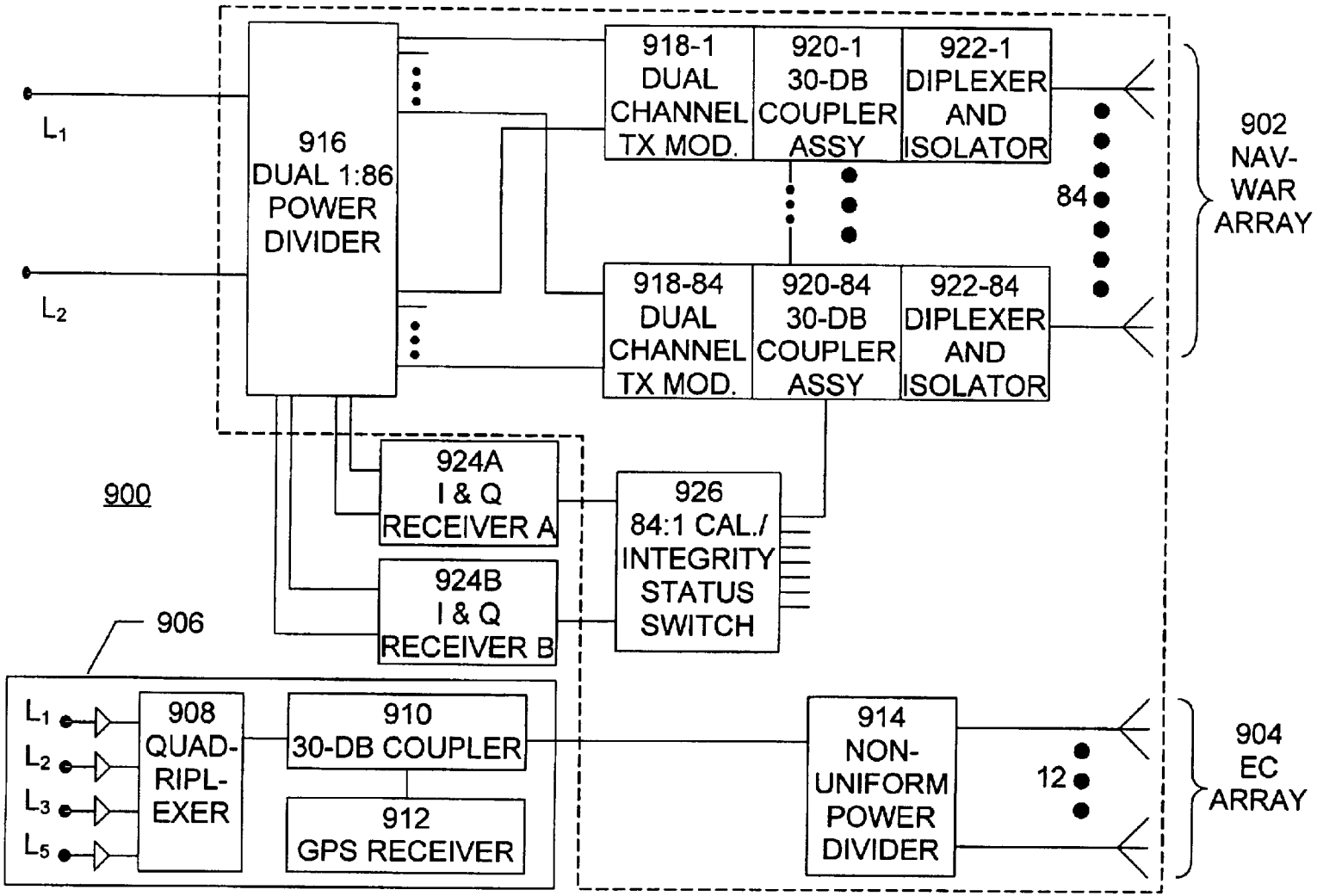
FIG. 9 is an exemplary block diagram of one embodiment of a next generation Global Positioning System (GPS) navigation transmit subsystem in which the present invention may be implemented.

Referring now to FIG. 9, one embodiment of an exemplary block diagram of a next generation Global Positioning System (GPS) navigation transmit subsystem 900 is shown. One skilled in the art will appreciate that this particular embodiment is merely an example of a subsystem that may advantageously utilize the present invention, and that the present invention may be used with or on any type of spacecraft, transmitting subsystem, or receiving subsystem. In the illustrated embodiment, spacecraft 900 includes two concentric antenna arrays; a Navigation Warfare (Nav-War) antenna array 902, and an Earth Coverage (EC) antenna array 904. In one embodiment, EC antenna array 904 provides a signal type and signal coverage similar to that provided by current GPS spacecraft. Specifically, EC antenna array 904 covers the earth, which is approximately +/−14 degrees viewed from the spacecraft. For the next generation GPS there is a need also for a Nav-War antenna, such as Nav-War antenna array 902, which has a much narrower beam and more power in order to give sufficient signal-to-noise ratio during jamming. A narrower beam requires a larger antenna aperture compared to the EC antenna.

A GPS receiver on the ground, on the water, in flight, or anywhere else typically receives signals from multiple spacecraft (i.e., typically 4 or more spacecraft) at any given time, from which the GPS receiver can determine its location. Important information for the GPS receiver may be the electrical distance to the center of gravity of the spacecraft, which is shown in FIG. 1. Since GPS spacecraft typically perform a continuous yaw maneuver, the distance correction required to correct for the difference between the distance from the GPS receiver to the center of the Nav-War antenna and the distance from the GPS receiver to the satellite center of gravity will need to be continuously updated, unless the Nav-War antenna is concentric with the spacecraft axis of rotation. The exact timing of yaw maneuvers is not known sufficiently accurately by the GPS receiver to permit an open loop correction scheme. Thus, the spacecraft would need to continually transmit the correction factor. The use of a concentric antenna array configuration eliminates the need for the GPS receiver to be given dynamic update information for the spacecraft orientation.

In the embodiment illustrated in FIG. 9, the circuitry connected to EC array 904 includes circuitry 906 which may be embodied in the navigation payload of spacecraft 900. Circuitry 906 includes quadriplexer 908, coupler 910, and GPS receiver 912. Quadriplexer 908 receives four signals, L1, L2, L3, and L5, which are to be transmitted by EC array 904. Quadriplexer 908 outputs each of the four input signals onto a single output signal, which is connected to the input of coupler 910. Coupler 910 couples the signal, with a 30 dB attenuation, to the input to GPS receiver 912. GPS receiver 912 virtually continuously checks the integrity of the transmitted waveform. Coupler 910 also couples the signal, with minimal attenuation, to a non-uniform power divider 914. Power divider 914 divides the signal among the elements of EC array 904, in a non-uniform fashion. That is, some elements of array 904 receive greater power levels than other elements. As one skilled in the art will appreciate, the power levels and relative phases are selected in a known manner to create an earth coverage beam.

Further, the circuitry connected to Nav-War array 902 comprises a power divider 916, and a plurality of dual channel transmit modules 918-1 to 918-84. Each dual channel transmit module includes coupler assemblies, such as coupler assemblies 920, and diplexers and isolators, such as diplexers and isolators 922. In one embodiment, each diplexer/isolator block 922 includes two isolators and one diplexer. Also connected to Nav-War array 902 are I & Q receivers 924A and 924B, and switch 926.

In the embodiment illustrated in FIG. 9, power divider 916 is a dual 1:86 power divider. Power divider 916 receives two signals, L1 (1.575 GHz), and L2 (1.227 GHz), which are to be transmitted by Nav-War array 902. Power divider 916 separately divides each input signal among 86 outputs. Eighty four of the outputs of each signal are connected to eighty four channels of circuitry that feed Nav-War array 902. In one embodiment, these 84 outputs typically all have substantially the same power level. The last two outputs of power divider 916 typically have substantially the same power level as the other. This power level may be different to the power level of the first 84 outputs.

As discussed above, each channel includes a dual channel transmit module 918, which includes a coupler assembly 920, and a diplexer and isolator 922. For example, channel 1 includes dual channel transmit module 918-1, which includes coupler assembly 920-1 and diplexer and isolator 922-1. Module 918-1 is a dual channel module, which receives divided signals from both L1, and L2 from power divider 916. Module 918-1 includes phase shifters/attenuators and amplifiers for each of the two input signals. The phase shifters/attenuators generate a phase and amplitude relationship for each of the two signals to form two phase/gain weighted transmit signals. Each of the eighty-four pairs of transmit signals has a particular phase and amplitude relationship to enable Nav-War array 902, which is a phased array antenna, to produce the proper antenna pattern, as is well known. Coupler assembly 920-1 couples the L1 and L2 transmit signals, with a 30 dB attenuation, to an input of switch 926. Coupler assembly 920-1 also couples the transmit signals, with minimal attenuation, to diplexer and isolator 922-1. Diplexer and isolator 922-1 outputs each of the two transmit signals onto its single output signal, which is connected to an element of Nav-War array 902. One skilled in the art will appreciate that dual channel transmit modules 918-2–918-84 are similarly configured.

One output of each signal from power divider 916 is connected to I & Q receiver 924A and one output of each signal from power divider 916 is connected to I & Q receiver 924B. In addition one output from switch 926 is connected to each I & Q receiver. Switch 926 is an 84:1 switch, which can selectively connect the output from one coupler from among the eighty-four couplers 920-1 to 920-84 to each of the outputs from switch 926. I & Q receivers 924A and 924B compare the waveform present in the output of the selected dual channel transmit module to the antenna array input signal. I & Q receivers 924A and 924B then detect any corruption of the navigation waveform by the antenna. If the magnitude of the signal corruption is sufficiently great to create a risk of a GPS receiver generating hazardous or misleading information, a warning message is transmitted. If the navigation waveform is not corrupted, I & Q receivers 924A and 924B measure the amplitude and phase of the signal at the output to the dual channel module relative to the input signal. In this manner, it is possible to confirm that the desired signal amplitude and phase is being supplied to each radiating element in the array, which, in turn, ensures that the antenna beam pattern is correct. I & Q receivers 924A and 924B perform these functions on both the L1 and L2 signals. In one embodiment, two I & Q receivers are included in the architecture to provide redundancy. Cal/integrity status switch 926 is internally redundant.

Figure 10:
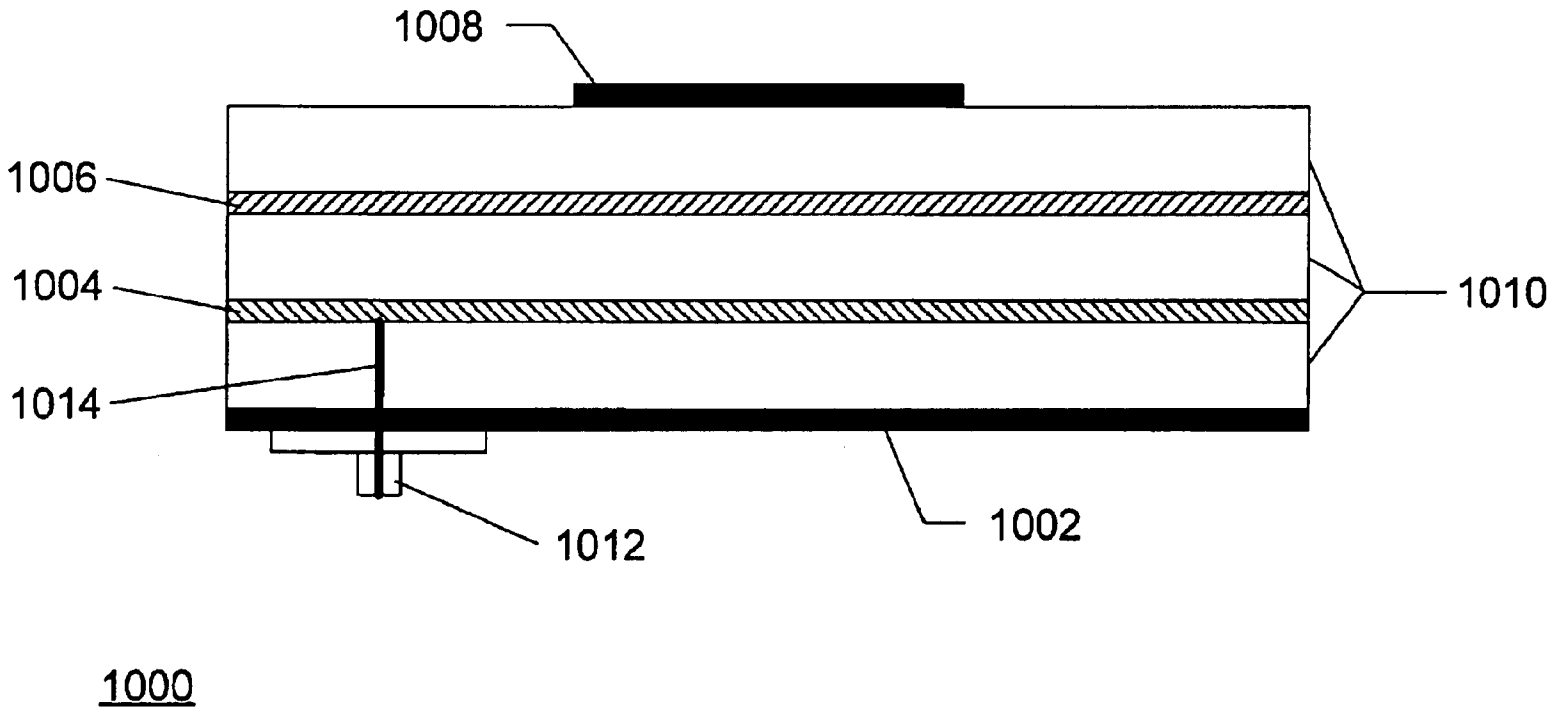
FIG. 10 is an illustration of one embodiment of a planar antenna module that may be used to implement the present invention.

Referring now to FIG. 10, one embodiment of an exemplary planar antenna module 000 that may be used to implement the present invention is shown. In this embodiment, module 1000 includes a ground plane 1002, a strip-line power divider layer 1004, a slotted layer 1006, a patch element layer 1008, dielectric spacers 1010, a coax connector 1012, and a feed probe 1014. Patch element layer 1008 includes one or more planar patch antenna elements, which radiate the transmitted signals. Coax connector 1012 connects module 1000 to signal generation circuitry and provides an input for the signals to be transmitted. Circuitry printed on strip-line power divider layer 1004 divides the input signals to be transmitted among the patch antenna elements. Slots incorporated in slotted layer 1006 couple signals from transmission lines incorporated in power divider layer 1004 to patch elements configured in patch element layer 1008. Dielectric spacers 1010 provide electrical isolation between layers, while ground plane 1002 provides the necessary ground plane for proper transmission of the signals. Feed probe 1014 feeds the input signal from coax connector 1012 to strip-line power divider layer 1004.

Figure 11:
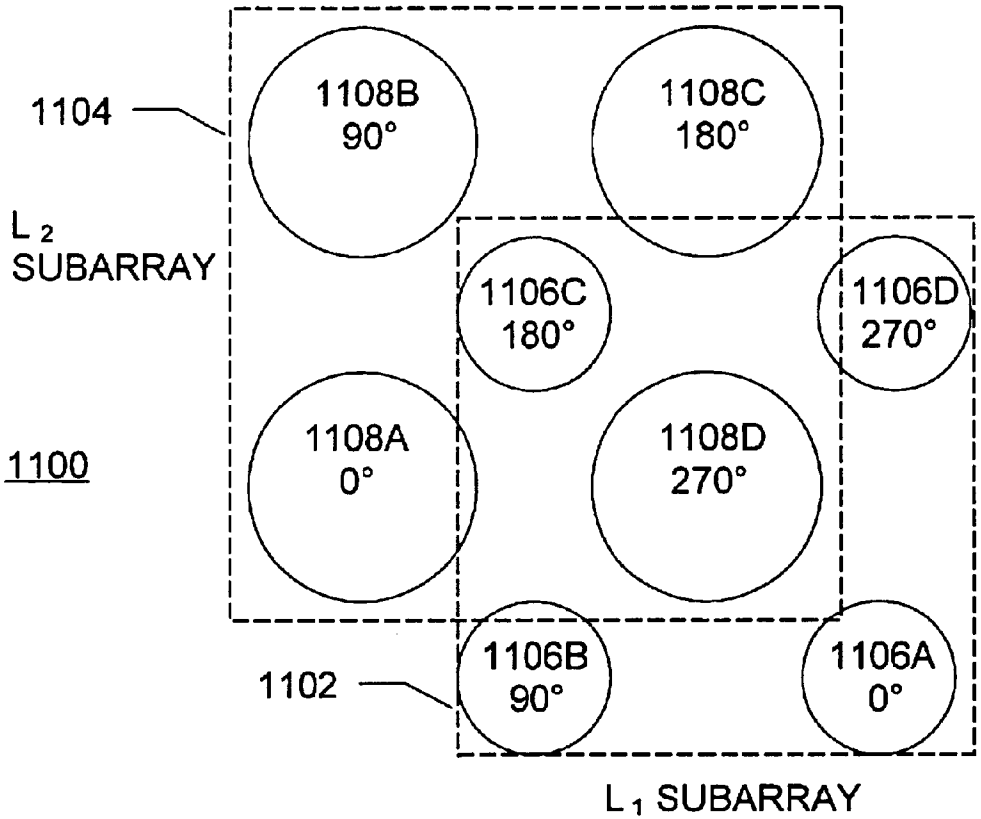
FIG. 11 is an illustration of an example of an antenna element sub-array that may be implemented by the planar antenna module shown in FIG. 10.

An example of one embodiment of an antenna element sub-array 1100 implemented by the planar antenna module shown in FIG. 10, is shown in FIG. 11. Sub-array 1100 includes two element sub-arrays, L1 sub-array 1102 and L2 sub-array 1104. In this embodiment, each sub-array includes four antenna elements. For example, L1 sub-array 1102 includes elements 1106A-D, and L2 sub-array 1104 includes elements 1108A-D. One skilled in the art will appreciate that this arrangement is only an example, and other numbers of elements may be used in each sub-array and other numbers of sub-arrays may be used in each module.

Figure 12:
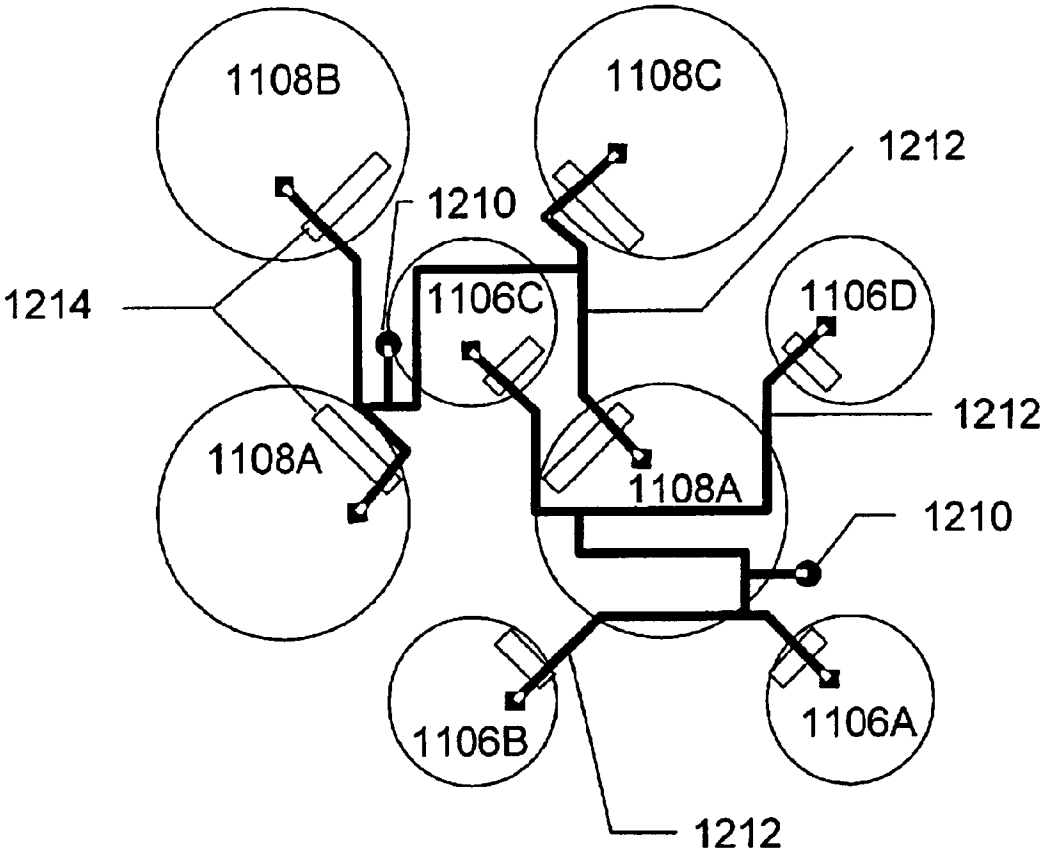
FIG. 12 is an illustration of an example of electrical connections of elements in the sub-arrays shown in FIG. 11.

An example of one embodiment of a signal feed network 1200 of the antenna element sub-array shown in FIG. 11 is shown in FIG. 12. In one embodiment, feed probes, for example feed probes 1014 shown in FIG. 10, are connected to strip-line circuitry inputs 1202. In this embodiment, each signal from inputs 1202 are split into 4 signal paths having 0, 90, 180 and 270 degree relative phases. In the illustrated embodiment, the signal paths are designated 1212 and are realized in layer 1004 in FIG. 10. The signal paths feed the patch elements 1106A–D, for signal L1, and patch elements 1108A–D, for signal L2, through the feed slots 1210 realized in layer 1006, shown in FIG. 10.

Figure 13:
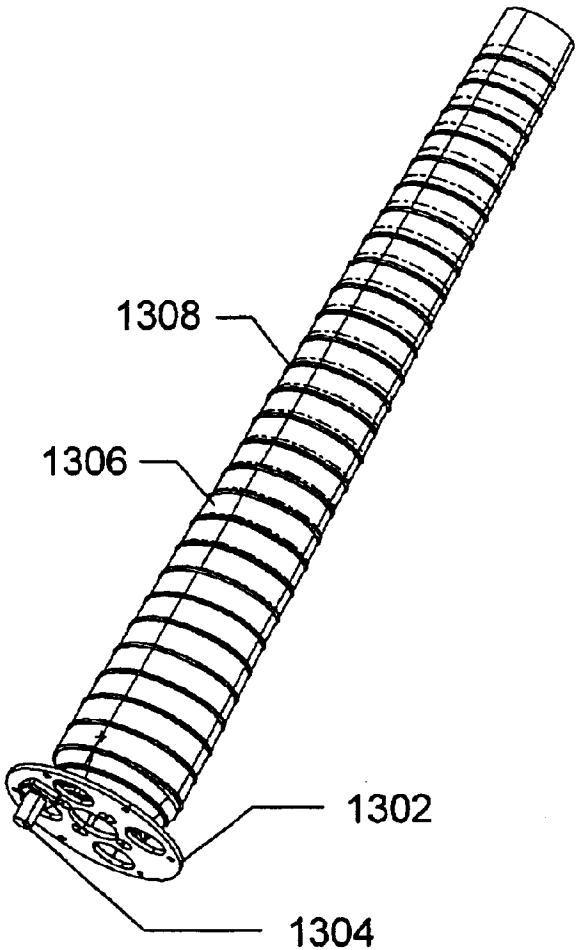
FIG. 13 is an illustration of one embodiment of a helical antenna element that may be used to implement the present invention.

An example of one embodiment of a helical antenna element 1300 that may be used to implement the present invention is shown in FIG. 13. Element 1300 includes a baseplate 1302, a coax connector 1304, a dielectric support 1306, and a helix wire 1308. Helix wire 1308 is a multi-turn helical coil of wire, which forms the radiating element that radiates the transmitted signals. Coax connector 1304 connects element 1300 to signal generation circuitry and provides input for the signals to be transmitted. Dielectric support 1306 provides physical support for helix wire 1308 and provides electrical isolation between segments of the wire. Baseplate 1302 provides mounting and physical support for element 1300.

Figure 14:
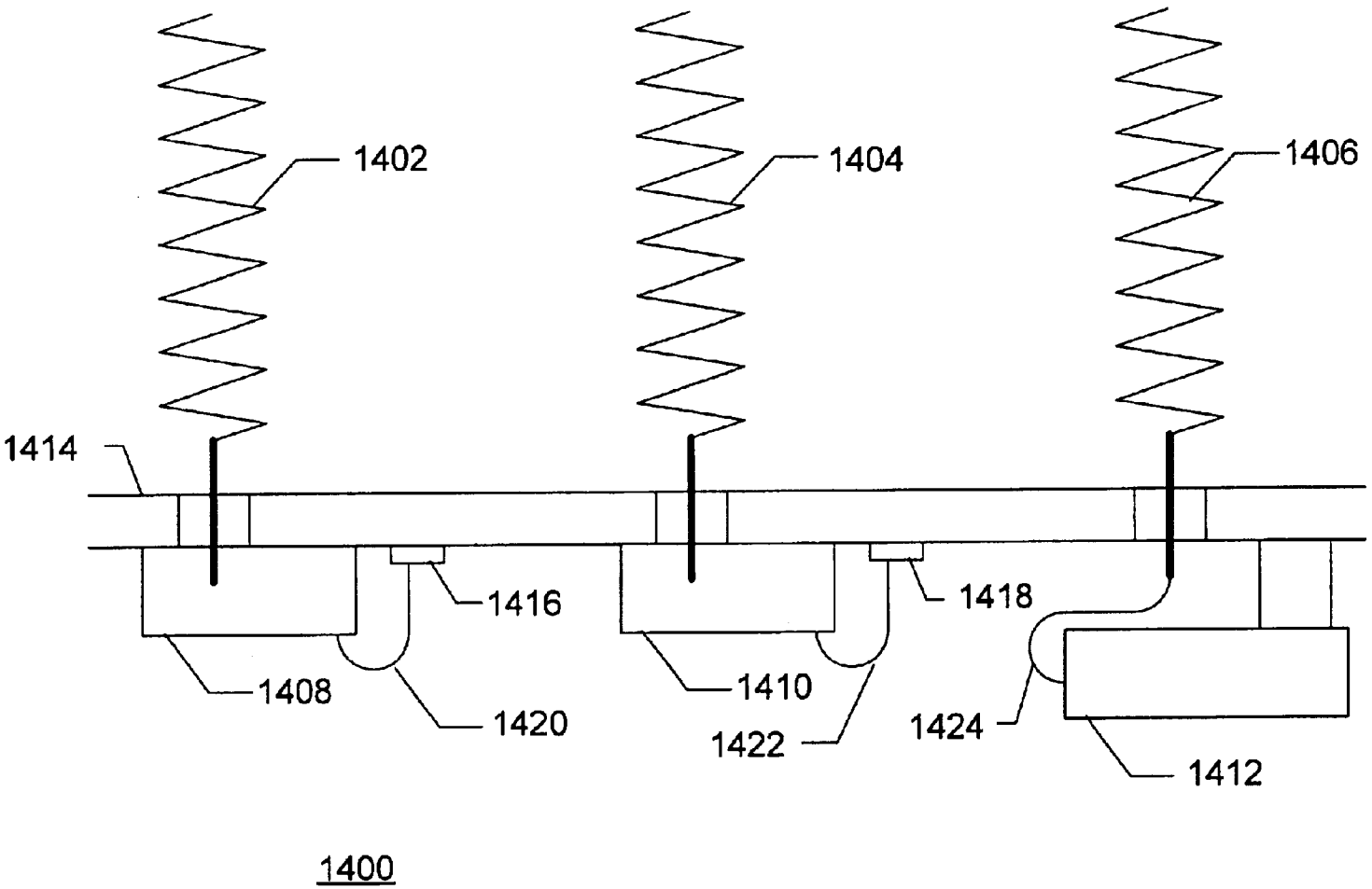
FIG. 14 is an illustration of one embodiment of a physical arrangement of helical antenna elements and circuitry by which the present invention may be implemented.

An example of one embodiment of a physical arrangement 1400 of helical antenna elements and circuitry by which the present invention may be implemented is shown in FIG. 14. The embodiment shown in FIG. 14 illustrates only a portion of an antenna array that would be implemented in accordance with the present invention. Arrangement 1400 includes a plurality of helical antenna elements, such as Nav-War elements 1402 and 1404, and EC element 1406, diplexers 1408 and 1410, and EC power divider 1412 mounted on panel 1414. Helical antenna elements 1402, 1404, and 1406 are similar to the example shown in FIG. 13. Nav-War elements 1402 and 1404 transmit the Nav-War signals described above, while EC element 1406 transmits the EC signals described above. Diplexers 1408 and 1410 couple transmit signals to elements 1402 and 1404, respectively. Diplexers 1408 and 1410 and divider 1412 are mounted on panel 1414, as are transmit modules 1416 and 1418. The signals from transmit modules 1416 and 1418 are connected to diplexers 1408 and 1410, respectively, by coax cables 1420 and 1422, respectively. A signal from divider 1412 is connected to element 1406 by coax cable 1424.

Figure 15:
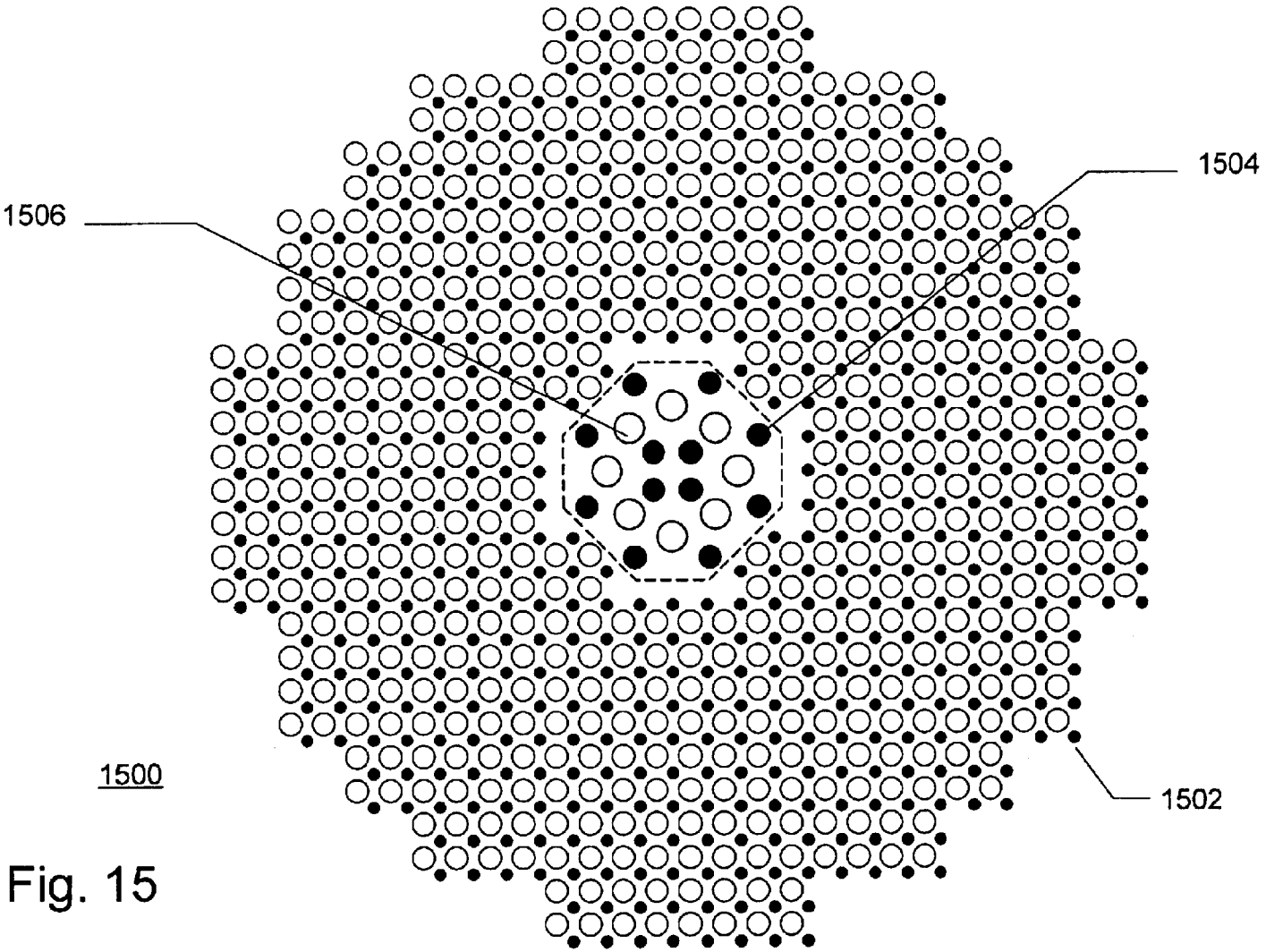
FIG. 15 is an illustration of one embodiment of an exemplary concentric arrangement of multiple spacecraft antennas in accordance with the present invention.

One embodiment of an exemplary concentric arrangement of multiple spacecraft antennas 1500 is shown in FIG. 15. Antenna arrangement 1500 includes a first concentric antenna array 1502, a second concentric antenna array 1504, and a third concentric antenna array 1506. Antenna array 1502, antenna array 1504 and antenna array 1506 are mounted, for example, on a spacecraft bus 102, shown in FIG. 1, symmetrically about the yaw axis of rotation. In this embodiment, antenna array 1502 includes a plurality of dual antenna element sub-arrays, such as is shown in FIG. 12. Antenna array 1504 includes a concentric array of twelve antenna elements. Antenna array 1506 includes a concentric array of 8 elements located between the inner and outer rings of antenna elements of array 1504.

In one embodiment of the present invention, antenna array 1502 is a Navigation Warfare Global Positioning System (Nav-War) array, while antenna array 1504 is an Earth Coverage Global Positioning System (EC) array and antenna array 1506 is a communications array. It is to be noted that a GPS spacecraft with Nav-War and EC antenna arrays is only one example of an implementation of the present invention. One skilled in the art would recognize that the present invention is equally applicable to other systems and that the present invention contemplates application to other such systems.

Although specific embodiments of the present invention have been described, it will be understood by those of skill in the art that there are other embodiments that are equivalent to the described embodiments. For example, the present invention may be equally applicable to other types of spacecraft, such as communications satellites. Communications satellites handle communications traffic by relaying radio frequency signals between two or more ground stations. Communications satellites, and other spacecraft, may need to maneuver in order to maintain proper pointing of spacecraft antennas at terrestrial antennas. However, during such a maneuver, those antennas that are not aligned with the yaw axis of rotation or center of gravity of the spacecraft may experience signal disruption. Thus, the present invention maybe advantageously applied to such satellites.

As another example, the present invention is applicable to spacecraft having more than two concentric antenna arrays. For example, there may be applications in which three, four, or even more concentric antenna arrays are needed. The present invention contemplates two or any number greater than two concentric antenna arrays. The invention is also applicable to other vehicles (e.g. cars, trucks, ships and aircraft) which may perform yaw maneuvers.

What is claimed is:

1. An arrangement of multiple antennas comprising:

a first antenna array mounted on a space vehicle, the first antenna array mounted symmetrically about a yaw axis of the space vehicle; and a second antenna array, functionally separate from the first antenna array mounted on the space vehicle, the second antenna array having a coincident or overlapping frequency band as the first antenna array and mounted symmetrically about the yaw axis of the vehicle in a central portion of the first antenna array so as to be concentric with the first antenna array and the vehicle yaw axis.

2. The arrangement of claim 1, wherein the first antenna array comprises a plurality of antenna elements.

3. The arrangement of claim 2, wherein the second antenna array comprises a plurality of antenna elements.

4. The arrangement of claim 3, wherein the elements of the second antenna array are interleaved with at least a portion of the elements of the first antenna array.

5. The arrangement of claim 4, wherein the plurality of antenna elements of the second antenna array have an even spacing.

6. The arrangement of claim 5, wherein the plurality of antenna elements of the first antenna array have an uneven spacing.

7. The arrangement of claim 4, wherein the plurality of antenna elements of the first antenna array have an even spacing.

8. The arrangement of claim 7, wherein the plurality of antenna elements of the second antenna array have an uneven spacing.

9. The arrangement of claim 4, wherein the plurality of antenna elements of the first antenna array have an uneven spacing.

10. The arrangement of claim 9, wherein the plurality of antenna elements of the second antenna array have an even spacing.

11. The arrangement of claim 4, wherein the plurality of antenna elements of the second antenna array have an uneven spacing.

12. The arrangement of claim 11, wherein the plurality of antenna elements of the first antenna array have an even spacing.

13. The arrangement of claim 4, wherein the plurality of antenna elements of the first antenna array and the plurality of antenna elements of the second antenna array have an even spacing.

14. The arrangement of claim 4, wherein the plurality of antenna elements of the first antenna array and the plurality of antenna elements of the second antenna array have an uneven spacing.

15. The arrangement of claim 4, wherein the first antenna array is a Navigation Warfare Global Positioning System antenna.

16. The arrangement of claim 15, wherein the second antenna array is an Earth Coverage Global Positioning System antenna.

17. The arrangement of claim 3, wherein the elements of the second antenna array are mounted in an area that includes no elements of the first antenna array.

18. The arrangement of claim 17, wherein the plurality of antenna elements of the second antenna array have an even spacing.

19. The arrangement of claim 18, wherein the plurality of antenna elements of the first antenna array have an uneven spacing.

20. The arrangement of claim 17, wherein the plurality of antenna elements of the first antenna array have an even spacing.

21. The arrangement of claim 20, wherein the plurality of antenna elements of the second antenna array have an uneven spacing.

22. The arrangement of claim 17, wherein the plurality of antenna elements of the first antenna array have an uneven spacing.

23. The arrangement of claim 22, wherein the plurality of antenna elements of the second antenna array have an even spacing.

24. The arrangement of claim 17, wherein the plurality of antenna elements of the second antenna array have an uneven spacing.

25. The arrangement of claim 24, wherein the plurality of antenna elements of the first antenna array have an even spacing.

26. The arrangement of claim 17, wherein the plurality of antenna elements of the first antenna array and the plurality of antenna elements of the second antenna array have an even spacing.

27. The arrangement of claim 17, wherein the plurality of antenna elements of the first antenna array and the plurality of antenna elements of the second antenna array have an uneven spacing.

28. The arrangement of claim 13, wherein the first antenna array is a Navigation Warfare Global Positioning System antenna.

29. The arrangement of claim 28, wherein the second antenna array is an Earth Coverage Global Positioning System antenna.

30. The arrangement of claim 1, further comprising:

at least one additional antenna array mounted symmetrically about the yaw axis of the spacecraft so as to be concentric with the first antenna array.

31. The arrangement of claim 30, wherein the at least one additional antenna array has a coincident or overlapping frequency band as the first antenna array.

32. The arrangement of claim 31, wherein the at least one additional antenna array is concentric with the first antenna array.

33. A spacecraft comprising:

an arrangement of multiple spacecraft antennas comprising:

a first antenna array mounted on a spacecraft bus, the first antenna array mounted symmetrically about a yaw axis of the spacecraft; and a second antenna array, functionally separate from the first antenna array mounted on the spacecraft bus, the second antenna array having a coincident or overlapping frequency band as the first antenna array and mounted symmetrically about the yaw axis of the spacecraft in a central portion of the first antenna array so as to be concentric with the first antenna array.

34. The spacecraft of claim 33, wherein the first antenna array comprises a plurality of antenna elements.

35. The spacecraft of claim 34, wherein the second antenna array comprises a plurality of antenna elements.

36. The spacecraft of claim 35, wherein the elements of the second antenna array are interleaved with at least a portion of the elements of the first antenna array.

37. The spacecraft of claim 36, wherein the plurality of antenna elements of the second antenna array have an even spacing.

38. The spacecraft of claim 37, wherein the plurality of antenna elements of the first antenna array have an uneven spacing.

39. The spacecraft of claim 36, wherein the plurality of antenna elements of the first antenna array have an even spacing.

40. The spacecraft of claim 39, wherein the plurality of antenna elements of the second antenna array have an uneven spacing.

41. The spacecraft of claim 36, wherein the plurality of antenna elements of the first antenna array have an uneven spacing.

42. The spacecraft of claim 41, wherein the plurality of antenna elements of the second antenna array have an even spacing.

43. The arrangement of claim 36, wherein the plurality of antenna elements of the second antenna array have an uneven spacing.

44. The arrangement of claim 43, wherein the plurality of antenna elements of the first antenna array have an even spacing.

45. The arrangement of claim 36, wherein the plurality of antenna elements of the first antenna array and the plurality of antenna elements of the second antenna array have an even spacing.

46. The arrangement of claim 36, wherein the plurality of antenna elements of the first antenna array and the plurality of antenna elements of the second antenna array have an uneven spacing.

47. The spacecraft of claim 36, wherein the first antenna array is a Navigation Warfare Global Positioning System antenna.

48. The spacecraft of claim 47, wherein the second antenna array is an Earth Coverage Global Positioning System antenna.

49. The arrangement of claim 35, wherein the elements of the second antenna array are mounted in an area that includes no elements of the first antenna array.

50. The arrangement of claim 49, wherein the plurality of antenna elements of the second antenna array have an even spacing.

51. The arrangement of claim 50, wherein the plurality of antenna elements of the first antenna array have an uneven spacing.

52. The arrangement of claim 49, wherein the plurality of antenna elements of the first antenna array have an even spacing.

53. The arrangement of claim 52, wherein the plurality of antenna elements of the second antenna array have an uneven spacing.

54. The arrangement of claim 49, wherein the plurality of antenna elements of the first antenna array have an uneven spacing.

55. The arrangement of claim 54, wherein the plurality of antenna elements of the second antenna array have an even spacing.

56. The arrangement of claim 49, wherein the plurality of antenna elements of the second antenna array have an uneven spacing.

57. The arrangement of claim 56, wherein the plurality of antenna elements of the first antenna array have an even spacing.

58. The arrangement of claim 49, wherein the plurality of antenna elements of the first antenna array and the plurality of antenna elements of the second antenna array have an even spacing.

59. The arrangement of claim 49, wherein the plurality of antenna elements of the first antenna array and the plurality of antenna elements of the second antenna array have an uneven spacing.

60. The arrangement of claim 49, wherein the first antenna array is a Navigation Warfare Global Positioning System antenna.

61. The arrangement of claim 60, wherein the second antenna array is an Earth Coverage Global Positioning System antenna.

62. The arrangement of claim 37, further comprising:

at least one additional antenna array mounted symmetrically about the yaw axis of the spacecraft so as to be concentric with the first antenna array.

63. The arrangement of claim 62, wherein the at least one additional antenna array has a coincident or overlapping frequency band as the first antenna array.

64. The arrangement of claim 63, wherein the at least one additional antenna array is concentric with the first antenna array.

* * * * *